US005457475A

United States Patent [19]

Maruyama et al.

[11] Patent Number: 5,457,475

[45] Date of Patent: Oct. 10, 1995

[54] IMAGE DISPLAY CONTROL APPARATUS

[75] Inventors: Toshihiko Maruyama; Akio Fukushima; Tomohiro Kimura, all of Tokyo, Japan

[73] Assignee: Pioneer Electronic Corporation, Tokyo, Japan

[21] Appl. No.: 160,289

[22] Filed: Dec. 2, 1993

Related U.S. Application Data

[63] Continuation of Ser. No. 915,629, Jul. 21, 1992, abandoned.

[30] Foreign Application Priority Data

Dec. 3, 1991 [JP] Japan ..... 3-319393

[51] Int. Cl.[6] ..... G09G 1/06

[52] U.S. Cl. ..... 345/123; 345/197; 345/200

[58] Field of Search ..... 345/203, 121, 345/123, 127, 200, 197

[56] References Cited

U.S. PATENT DOCUMENTS 4,633,415 12/1986 Vink et al. ..... 340/726

4,663,617 5/1987 Stockwell ..... 340/726

5,021,772 6/1991 King et al. ..... 340/726

5,053,761 10/1991 Webster, III ..... 340/799

*Primary Examiner*—Curtis Kuntz

*Assistant Examiner*—Minsun Oh

*Attorney, Agent, or Firm*—Fish & Richardson

[57] ABSTRACT

An image display control apparatus designed to reduce the memory capacity and the cost. The apparatus designates a display area for image data to be supplied to an image display device to first and second frame memories for respectively storing first and second image data in association with horizontal and vertical coordinates, and moves the designated display area in a predetermined direction in accordance with a scroll instruction. Image data of the designated display area is read out from the first and second frame memories, and third image data is written in that part of the designated display area of the first and second frame memories from which image data has been read out.

2 Claims, 12 Drawing Sheets

FIG. 4

| FIELD | MEMORY AREA $Y_A$ | | MEMORY AREA $Y_B$ | | SELECTOR 94Y L/H |
|---|---|---|---|---|---|
| | READ | WRITE | READ | WRITE | |
| $F_0$ | (0 ,0)<br>(1 ,0)<br>(2 ,0)<br>⋮<br>(xm, 0)<br>(0 ,2)<br>(1 ,2)<br>(2 ,2)<br>⋮<br>(xm, 2)<br>(0 ,4)<br>(1 ,4)<br>(2 ,4)<br>⋮<br>(xm, ym) | | | | L |

FIG. 5

| FIELD | MEMORY AREA $Y_A$ | | MEMORY AREA $Y_B$ | | SELECTOR 94Y L/H |
|---|---|---|---|---|---|
| | READ | WRITE | READ | WRITE | |
| $F_1$ | (0 ,1)<br>(1 ,1)<br>(2 ,1)<br>⋮<br>(xm,1)<br>(0 ,3)<br>(1 ,3)<br>(2 ,3)<br>⋮<br>(xm,3)<br>(0 ,5)<br>(1 ,5)<br>(2 ,5)<br>⋮<br>(xm,ym+1) | | | | L |

FIG. 6

| FIELD | MEMORY AREA $Y_A$ | | MEMORY AREA $Y_B$ | | SELECTOR 94Y L/H |
|---|---|---|---|---|---|
| | READ | WRITE | READ | WRITE | |
| $F_2$ | (0 ,16)<br>(1 ,16)<br>(2 ,16)<br>⋮<br>(xm,16)<br>(0 ,18)<br>(1 ,18)<br>(2 ,18)<br>⋮<br>(xm,18)<br>(0 ,20)<br>(1 ,20)<br>(2 ,20)<br>⋮<br>(xm,ym) | (0 ,0)<br>(1 ,0)<br>(2 ,0)<br>⋮<br>(xm,0)<br>(0 ,1)<br>(1 ,1)<br>(2 ,1)<br>⋮<br>(xm,1)<br>(0 ,2)<br>(1 ,2)<br>(2 ,2)<br>(3 ,2)<br>⋮<br>(xm,15) | | | L |
| | | | (0 ,0)<br>(1 ,0)<br>(2 ,0)<br>⋮<br>(xm,0)<br>(0 ,2)<br>(1 ,2)<br>(2 ,2)<br>⋮<br>(xm,14) | | H |

FIG. 7

| FIELD | MEMORY AREA $Y_A$ | | MEMORY AREA $Y_B$ | | SELECTOR 94Y L/H |
|---|---|---|---|---|---|
| | READ | WRITE | READ | WRITE | |
| $F_3$ | (0 ,33)<br>(1 ,33)<br>(2 ,33)<br>⋮<br>(xm,33)<br>(0 ,35)<br>(1 ,35)<br>(2 ,35)<br>⋮<br>(xm,35)<br>(0 ,37)<br>(1 ,37)<br>(2 ,37)<br>⋮<br>(xm,ym+1) | (0 ,16)<br>(1 ,16)<br>(2 ,16)<br>⋮<br>(xm,16)<br>(0 ,17)<br>(1 ,17)<br>(2 ,17)<br>⋮<br>(xm,17)<br>(0 ,18)<br>(1 ,18)<br>(2 ,18)<br>⋮<br>(xm,32) | | | L |
| | | | (0 ,1)<br>(1 ,1)<br>(2 ,1)<br>⋮<br>(xm,1)<br>(0 ,3)<br>(1 ,3)<br>(2 ,3)<br>⋮<br>(xm,31) | | H |

FIG. 8

| FIELD | MEMORY AREA $Y_A$ | | MEMORY AREA $Y_B$ | | SELECTOR 94Y L/H |
|---|---|---|---|---|---|
| | READ | WRITE | READ | WRITE | |
| $F_0$' | | | (0 ,0)<br>(1 ,0)<br>(2 ,0)<br>⋮<br>(xm,0)<br>(0 ,2)<br>(1 ,2)<br>(2 ,2)<br>⋮<br>(xm,2)<br>(0 ,4)<br>(1 ,4)<br>(2 ,4)<br>⋮<br>(xm,ym) | | H |

FIG. 9

| FIELD | MEMORY AREA $Y_A$ | | MEMORY AREA $Y_B$ | | SELECTOR 94Y L/H |
|---|---|---|---|---|---|
| | READ | WRITE | READ | WRITE | |
| $F_1'$ | | | (0 ,1)<br>(1 ,1)<br>(2 ,1)<br>⋮<br>(xm,1)<br>(0 ,3)<br>(1 ,3)<br>(2 ,3)<br>⋮<br>(xm,3)<br>(0 ,5)<br>(1 ,5)<br>(2 ,5)<br>⋮<br>(xm,ym+1) | | H |

FIG. 10

| FIELD | MEMORY AREA $Y_A$ | | MEMORY AREA $Y_B$ | | SELECTOR 94Y L/H |
|---|---|---|---|---|---|
| | READ | WRITE | READ | WRITE | |
| $F_2'$ | | | (0 ,16)<br>(1 ,16)<br>(2 ,16)<br>⋮<br>(xm,16)<br>(0 ,18)<br>(1 ,18)<br>(2 ,18)<br>⋮<br>(xm,18)<br>(0 ,20)<br>(1 ,20)<br>(2 ,20)<br>⋮<br>⋮<br>(xm,ym) | (0 ,0)<br>(1 ,0)<br>(2 ,0)<br>⋮<br>( m,0)<br>(0 ,1)<br>(1 ,1)<br>(2 ,1)<br>⋮<br>(xm,1)<br>(0 ,2)<br>(1 ,2)<br>(2 ,2)<br>⋮<br>(xm,15) | H |
| | (0 ,0)<br>(1 ,0)<br>(2 ,0)<br>⋮<br>(xm,0)<br>(0 ,2)<br>(1 ,2)<br>(2 ,2)<br>⋮<br>(xm,14) | | | | L |

IMAGE DISPLAY CONTROL APPARATUS

This application is a continuation of U.S. application Ser. No. 07/915,629filed Jul. 21, 1992, now abandoned.

BACKGROUND OF THE INVENTION

1 . Field of the Invention

The present invention relates to an image display control apparatus, and, more particularly, to an image display control apparatus which uses first through third image memories to accomplish predetermined screen effects.

2. Background of the Invention

Recently, the standardization of high definition still picture disks has been attempted. FIG. 1 presents a block diagram showing the fundamental structure of a system which handles such a disk.

Referring to FIG. 1, an image drive unit 1, an audio drive unit 2 and a control drive unit 3 access respective disks on which image data, audio data and control data are respectively recorded, and send read-out signals to a player 4.

The image data read out by the image drive unit 1 is supplied to the input terminal of a selector 5, which serves to selectively switch the output destinations for the input data received at its input terminal. The selector 5 has a first output terminal connected to the input terminal of a compression decoder 6 and a second output terminal connected to the input terminal of a selector 7 as well as the output terminal of the compression decoder 6. The compression decoder 6 has a decoding function with JPEG (Joint Photographic Expert Group: an international standard for compression of information of a still picture) base-line compression. The selector 7, which serves to selectively switch the output destinations for the data received at its input terminal, has first, second and third output terminals respectively connected to image memories 8*a*, 8*b* and 8*c*.

The image memories 8*a* to 8*c* as a whole have a 3-frame structure in order to exhibit predetermined effects, and are respectively treated as first, second and third memories each for one frame. In this respect, those image memories 8*a* to 8*c* are called "first, second and third frame memories". The output data of each of the three image memories is supplied to a screen effect controller 9 where it is subjected to predetermined screen effect control, such as cutting, dissolving, wiping, roll switching, continuous scroll or program wiping that involves data transfer between memories as its premise. The resultant signal is then supplied as an image signal to a CRT 10 as a display device.

The audio data read out by the audio drive unit 2 is subjected to predetermined signal processing in the player 4 to drive loudspeakers 11L and 11R. The control data read out by the control drive unit 3 is used in the player 4 for some control or the like to present predetermined screen effects. The operation of those individual devices described above is controlled by a control apparatus (not shown).

In this system, the mode is specified by the control data or through a manual operation to accomplish predetermined screen effect control. In the case where a continuous vertical scroll instruction is issued, one mode of the predetermined screen effect control, all of the first through third frame memories are used. This case will be discussed below more specifically.

The individual frame memories 8*a*, 8*b* and 8*c* constitute one memory space as shown in (a) in FIG. 2, with different pieces of image data stored in the respective frame memories. In the case where every piece of the image data in a broken lined frame d as a display area, or every piece of the image data stored in the first frame memory 8*a* is transferred from the screen effect controller 9 to the CRT 10 and is displayed thereon, when screen effect control corresponding to the continuous vertical scroll instruction is performed, the broken lined frame d moves to an area in the second frame memory 8*b* as shown in (b) in FIG. 2 so that part of the image data of the first frame memory 8*a* and part of the image data of the second frame memory 8*b* are displayed at the same time. When the continuous vertical scroll continues, the broken lined frame d moves further down in the diagram so that all the image data of the second frame memory 8*b* is displayed as shown in (c) in FIG. 2.

When the broken lined frame d leaves the area of the first frame memory 8*a* as shown in (c) in FIG. 2, image data supplied based on the image information from the image drive unit 1 is stored in the first frame memory 8*a* as image data to be displayed next. At the time, if the continuous vertical scroll continues, the broken lined frame d moves further down in the diagram so that part of the image data of the second frame memory 8*b* and part of the image data of the third frame memory 8*c* are displayed at the same time as shown in (d) in FIG. 2.

Then, when the broken lined frame d moves further down as shown in (e) in FIG. 2, all the image data of the third frame memory 8*c* is displayed and new image data is stored in the second frame memory 8*b*. When the downward movement of the broken lined frame d continues to be in the state shown in (f) in FIG. 2, part of the image data of the third frame memory 8*c* and part of the image data of the first frame memory 8*a* are displayed at the same time. Then, the broken lined frame d returns to the aforementioned state shown in (a) in FIG. 2 if the continuous vertical scroll is effective. Thereafter, the operational sequence from (a) to (f) in FIG. 2 is repeated until the continuous vertical scroll is disabled.

In executing continuous vertical scroll, the conventional apparatus needs three frame memories as described above.

There may be a case where other screen effect control than the predetermined one in the above system is executed during such continuous vertical scroll, e.g., where a user tries to accomplish the desired screen effect control with arbitrary image data the user has called to hold. In such a case, to store the necessary image data, a separate frame memory besides the first to third frame memories should be provided. Such need of additional memory is thought to be unsatisfactory in view of reducing the memory capacity and improving the cost performance.

SUMMARY OF THE INVENTION

It is therefore an object of the present invention to provide an image display control apparatus designed to reduce memory capacity and performance costs.

To achieve this object, the present invention provides an image display control apparatus comprising first and second frame memories for respectively storing first and second image data in association with horizontal and vertical coordinates; display area designating means for designating to the first and second frame memories a display area for image data to be supplied to image display means and moving the display area in a predetermined direction in accordance with a scroll instruction; read means for reading image data of the display area, designated by the display area designating means, from the first and second frame memories; and write means for writing third image data in that part of the designated display area of the first and second frame memories from which image data has been read out by the read means.

The image display control apparatus embodying the present invention writes third image data into that part of a display area designated to the first and second frame memories from which image data has been read out.

BRIEF DESCRIPTION OF THE DRAWINGS

FIGS. 4 through 10 present timing tables for explaining the operation of the image display control apparatus shown in FIG. 3;

DETAILED DESCRIPTION OF THE INVENTION

Figure 1:
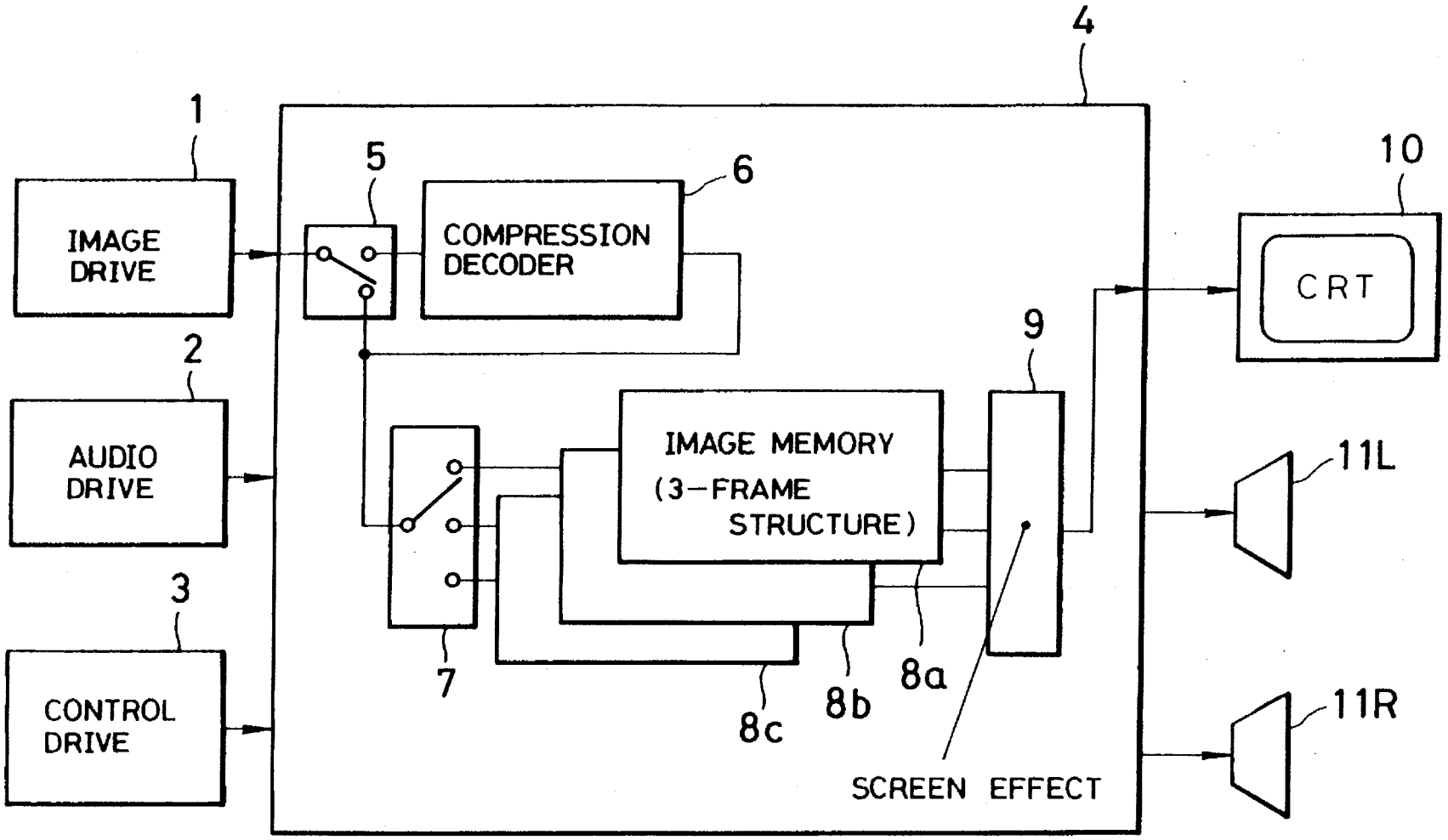
FIG.1 PRIOR ART
FIG. 1 is a block diagram illustrating the structure of a high definition still picture system.
Figures 2A, 2B, 2C, 2D, 2E, 2F:
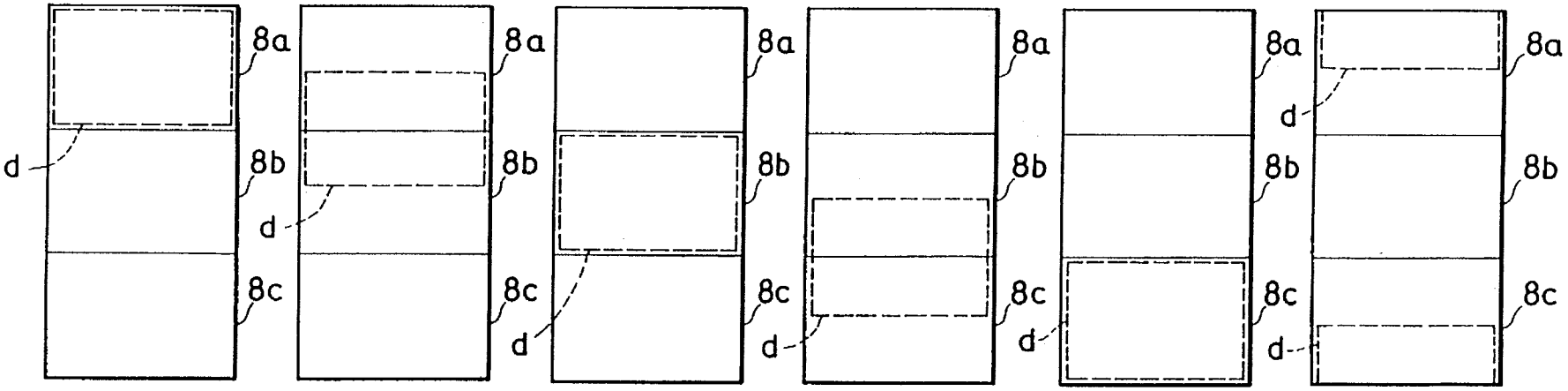
FIG. 2(a) PRIOR ART
FIG. 2(b) PRIOR ART
FIG. 2(c) PRIOR ART
FIG. 2(d) PRIOR ART
FIG. 2(e) PRIOR ART
FIG. 2(f) PRIOR ART
FIG. 2 is a diagram for explaining the operation of the system shown in FIG. 1.
Figure 3:
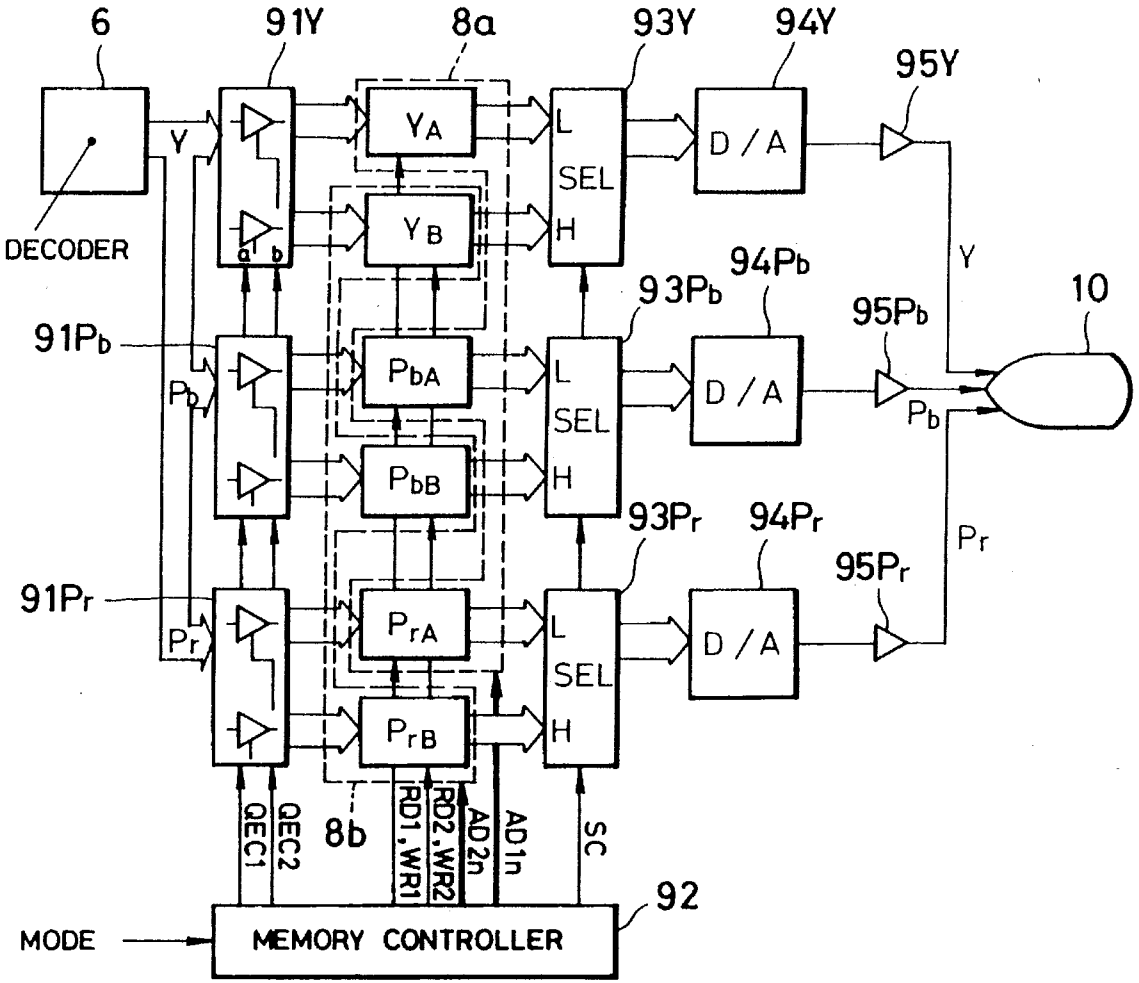
FIG. 3 is a block diagram of an image display control apparatus according to one embodiment of the present invention.

A preferred embodiment of the present invention will now be described referring to the accompanying drawings. FIG. 3 presents a basic block diagram of an image display control apparatus according to one embodiment of the present invention, using the same reference numerals as used in FIG. 1 for corresponding or identical components.

Referring to FIG. 3, image data from a compression decoder 6 is separated into data Y representing a luminance signal and data Pb and Pr representing color difference signals. The data Y, Pb and Pr are respectively supplied to signal input terminals of three-state buffers 91Y, 91Pb and 91Pr, the first buffer 91Y for the luminance signal and the other two for the color difference signals. Each of the three-state buffers 91Y, 91Pb and 91Pr has buffers for two frames or enough to send the outputs to first and second frame memories 8*a* and 8*b*, and has output-control input terminals a and b for each frame. The three-state buffers 91Y, 91Pb and 91Pr send the respective data Y, Pb and Pr from the compression decoder 6 to the first frame memory 8*a* in response to a first output control signal OEC1 generated by a memory controller 92 or send them to the second frame memory 8*b* in response to a second output control signal OEC2 also from the memory controller 92.

Read and write accesses to the first frame memory 8*a* are controlled by a first read signal RD1, a first write signal WR1 and a first address signal AD1*n* all from the memory controller 92. Likewise, read and write accesses to the second frame memory 8*b* are controlled by a second read signal RD2, a second write signal WR2 and a second address signal AD2*n* also from the memory controller 92. The first frame memory 8*a* has memory areas $Y_A$, $Pb_A$ and $Pr_A$ for respectively storing the luminance signal and the two color difference signals. Those three memory areas $Y_A$, $Pb_A$ and $Pr_A$ respectively correspond to the three-state buffers 91Y, 91Pb and 91Pr that send out their outputs in response to the first output control signal OEC1. Likewise, the second frame memory 8*b* has memory areas $Y_B$, $Pb_B$ and $Pr_B$ which respectively correspond to the three-state buffers 91Y, 91Pb and 91Pr that send out their outputs in response to the second output control signal OEC2.

Individual pieces of output data of the first frame memory 8*a* are supplied to L-side signal input terminals of respective selectors 93Y, 93Pb and 93Pr provided for the luminance signal and the two color difference signals, respectively. Individual pieces of output data of the second frame memory 8*b* are respectively supplied to H-side signal input terminals of the selectors 93Y, 93Pb and 93Pr. The selecting actions of the selectors 93Y, 93Pb and 93Pr are controlled by a select control signal SC from the memory controller 92. The selected output of the selectors 93Y, 93Pb and 93Pr are sent to D/A converters 94Y, 94Pb and 94Pr respectively provided for the luminance signal and the two color difference signals. The D/A converters 94Y, 94Pb and 94Pr convert the received signals into analog luminance and color signals, which are in turn sent via respective video buffers 95Y, 95Pb and 95Pr to a CRT 10.

The memory controller 92, consisting of a microcomputer or the like, produces the aforementioned various control signals and address signals in accordance with the mode of the aforementioned predetermined screen effect control.

Figure 11:
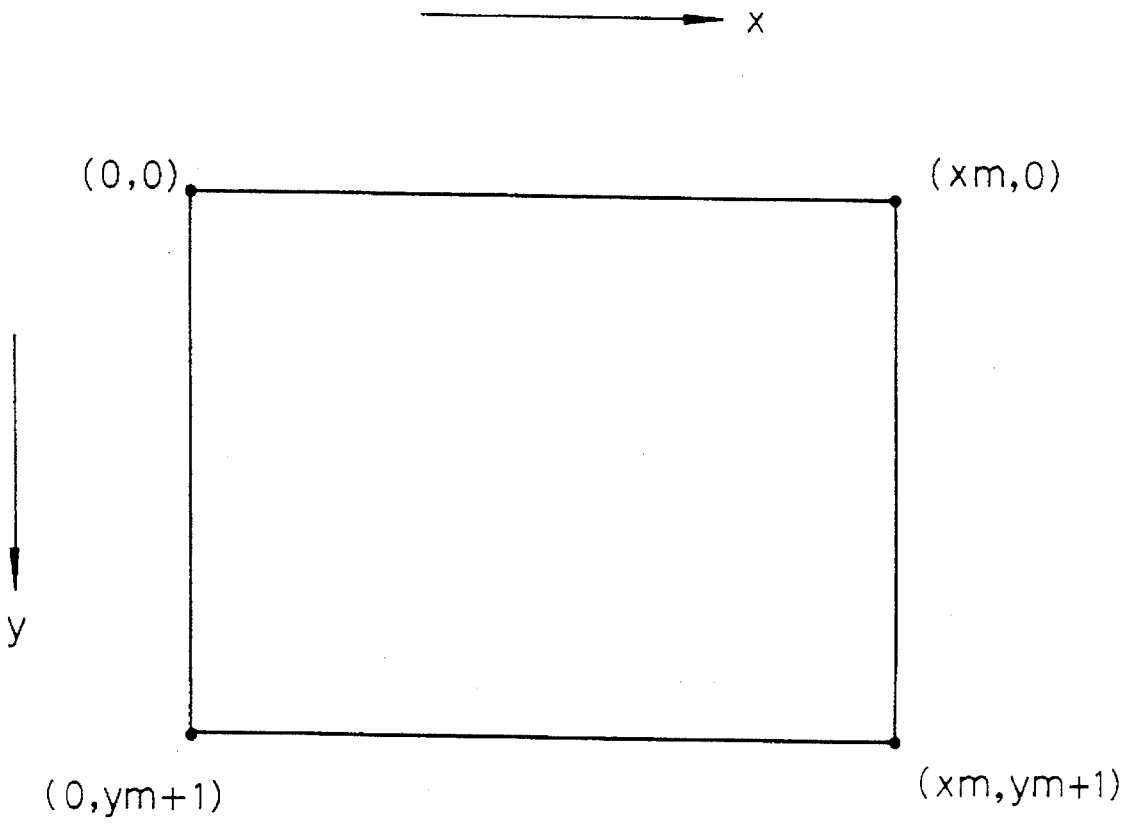
FIG. 11 is a diagram illustrating the coordinates of image data in a frame memory in FIG. 3.

The operation of the image display control apparatus will be described in detail with reference to timing tables given in FIGS. 4 through 10. The timing tables illustrate only part of the operation with respect to the luminance-signal memory areas $Y_A$ and $Y_B$ in the individual frame memories 8*a* and 8*b* in continuous vertical scroll. Those timing tables also illustrate the read and write status of the memory areas $Y_A$ and $Y_B$ of the first and second frame memories 8*a* and 8*b* and the selected status of the selector 93Y in each field in so-called screen scanning. The read and write status are expressed by (x, y), the coordinates of image data designated by the read/write address signals AD1*n* and AD2*n*, where x is the horizontal coordinate of image data in each frame memory and y is the vertical coordinate of that image data, as shown in FIG. 11. It is to be noted that xm is the maximum horizontal coordinate and ym+1 the maximum vertical coordinate.

Figures 12A, 12B, 12C, 12D, 12E:
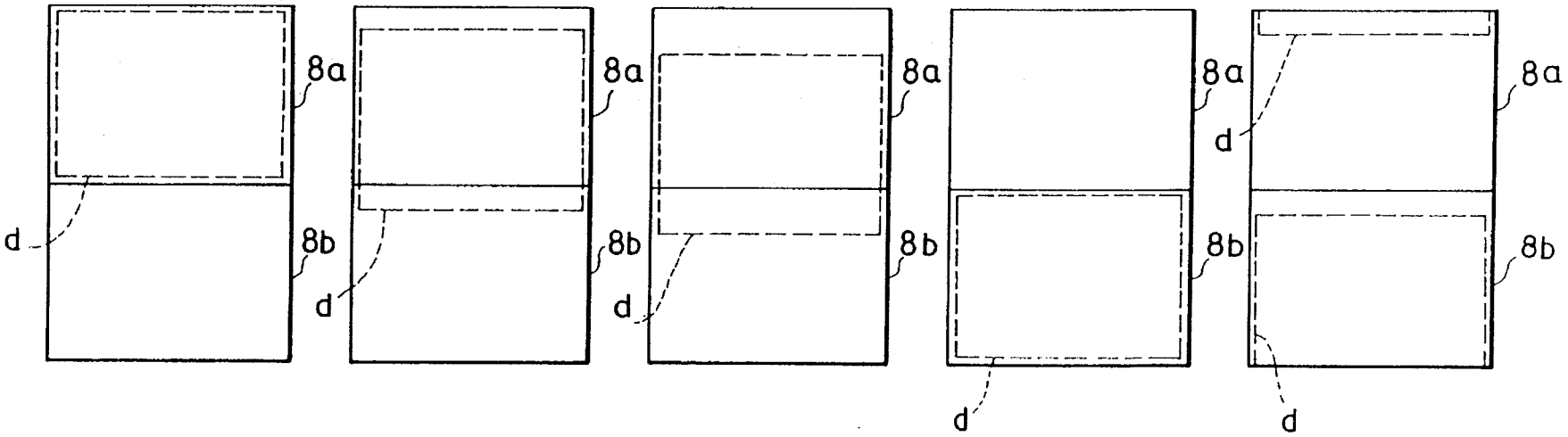
FIG. 12 is a diagram for explaining the operation of the image display control apparatus shown in FIG. 3.

In the case where image data in a broken lined frame d shown in (a) in FIG. 12 is supplied to the CRT 10 in order to display all the image data of the first frame memory 8*a*, the read/write control of each frame memory in an even-numbered field and an odd-numbered field and control on selective output to the CRT 10 are to be as shown in the timing tables in FIGS. 4 and 5.

As shown in FIG. 4, in an even-numbered field F0, the coordinates specified by the address signal AD1*n* are changed from (0, 0) to (xm, ym) in order in synchronism with the generation of the first read signal RD1 from the memory controller 92 in such a way that the y coordinate is incremented by two and the x coordinate is changed sequentially from 0 to xm for each y coordinate. Accordingly, luminance signal data at the specified coordinates is read out from the memory area $Y_A$ of the first frame memory 8*a*. At this time, the L-side input of the selector 93Y is selected by the select control signal SC and the read-out luminance signal data is sent to the CRT 10.

Likewise, in an odd-numbered field F1, as shown in FIG. 5, the coordinates specified by the address signal AD1*n* are changed from (0, 1) to (xm, ym+1) in order in synchronism with the generation of the first read signal RD1 from the memory controller 92 in such a way that the y coordinate is incremented by two and the x coordinate is changed sequentially from 0 to xm for each y coordinate. Accordingly, luminance signal data at the specified coordinates is read out from the memory area $Y_A$ of the first frame memory 8a. At this time, the L-side input of the selector 93Y is selected by the select control signal SC and the read-out luminance signal data is sent to the CRT 10.

In the case where the continuous vertical scroll instruction is issued and image data in the broken lined frame d shown in (b) in FIG. 12 is supplied to the CRT 10 in order to simultaneously display part of the image data of the first frame memory 8a and part of the image data of the second frame memory 8b, the read/write control of each frame memory in an even-numbered field following the field F1 and control on selective output to the CRT 10 become as shown in the timing table in FIG. 6.

Specifically, as shown in FIG. 6, in a field F2, the coordinates specified by the address signal AD1*n* are changed from (0, 16) to (xm, ym) in order in synchronism with the generation of the first read signal RD1 from the memory controller 92 in such a way that the y coordinate is incremented by two and the x coordinate is changed sequentially from 0 to xm for each y coordinate, while the specified coordinates are changed from (0, 0) to (xm, 15) in order in synchronism with the generation of the first write signal WR1 from the memory controller 92 in such a way that the y coordinate is incremented by one and the x coordinate is changed sequentially from 0 to xm for each y coordinate. Accordingly, luminance signal data at the specified coordinates is read out from the memory area $Y_A$ of the first frame memory 8a in synchronism with the first read signal RD1, and luminance signal data from the three-state buffer 91Y is written at the specified coordinates in synchronism with the first write signal WR1. At this time, the L-side input of the selector 93Y is selected by the select control signal SC and the luminance signal data read out from the memory area $Y_A$ is sent to the CRT 10.

After reading of the luminance signal data at the coordinates (xm, ym) from the memory area $Y_A$ is complete, the coordinates specified by the address signal AD2*n* are changed from (0, 0) to (xm, 14) in order in synchronism with the generation of the second read signal RD2 from the memory controller 92 in such a way that the y coordinate is incremented by two and the x coordinate is changed sequentially from 0 to xm for each y coordinate. Accordingly, luminance signal data at the specified coordinates is read out from the memory area $Y_B$ of the second frame memory 8b in synchronism with the second read signal RD2. At this time, the H-side input of the selector 93Y is selected by the select control signal SC and the luminance signal data read out from the memory area $Y_B$ is sent to the CRT 10.

In the case where the continuous vertical scroll continues to move the display area and image data in the broken lined frame d shown in (c) in FIG. 12 is supplied to the CRT 10, the read/write control of each frame memory in an odd-numbered field following the field F2 and control on selective output to the CRT 10 become as shown in the timing table in FIG. 7.

As shown in FIG. 7, in a field F3, the coordinates specified by the address signal AD1*n* are changed from (0, 33) to (xm, ym+1) in order in synchronism with the generation of the first read signal RD1 from the memory controller 92 in such a way that the y coordinate is incremented by two and the x coordinate is changed sequentially from 0 to xm for each y coordinate, while the specified coordinates are changed from (0, 16) to (xm, 32) in order in synchronism with the generation of the first write signal WR1 from the memory controller 92 in such a way that the y coordinate is incremented by one and the x coordinate is changed sequentially from 0 to xm for each y coordinate. Accordingly, luminance signal data at the specified coordinates is read out from the memory area $Y_A$ of the first frame memory 8a in synchronism with the first read signal RD1, and luminance signal data from the three-state buffer 91Y is written at the specified coordinates in synchronism with the first write signal WR1. At this time, the L-side input of the selector 93Y is selected by the select control signal SC and the luminance signal data read out from the memory area $Y_A$ is sent to the CRT 10.

After reading of the luminance signal data at the coordinates (xm, ym+1) from the memory area $Y_A$ is complete, the coordinates specified by the address signal AD2*n* are changed from (0, 1) to (xm, 31) in order in synchronism with the generation of the second read signal RD2 from the memory controller 92 in such a way that the y coordinate is incremented by two and the x coordinate is changed sequentially from 0 to xm for each y coordinate. Accordingly, luminance signal data at the specified coordinates is read out from the memory area $Y_B$ of the second frame memory 8b in synchronism with the second read signal RD2. At this time, the H-side input of the selector 93Y is selected by the select control signal SC and the luminance signal data read out from the memory area $Y_B$ is sent to the CRT 10.

If the scroll likewise continues and image data in the broken lined frame d shown in (d) in FIG. 12 is supplied to the CRT 10 in order to display all the image data of the first frame memory 8a, the read/write control of each frame memory in an even-numbered field F0' or an odd-numbered field F1' and control on selective output to the CRT 10 become as shown in the timing tables in FIGS. 8 and 9.

In the case where image data in the broken lined frame d shown in (e) in FIG. 12 is supplied to the CRT 10 in order to simultaneously display part of the image data of the second frame memory 8b and part of the image data of the first frame memory 8a, the read/write control of each frame memory in a field F2' and control on selective output to the CRT 10 become as shown in the timing table given in FIG. 10.

The feature of this embodiment lies in that the third frame memory which is originally or conventionally required to effect the continuous vertical scroll is not used, and this continuous vertical scroll is accomplished using only two frame memories (first and second frame memories). This feature permits the third frame memory to be used for other purposes during the continuous vertical scrolling, thus providing sufficient functions involving the third frame memory without impairing the original functions of the system and reducing the overall memory capacity of the system and the manufacturing cost.

Although this embodiment has been discussed in the foregoing description with reference only to the case the vertical movement of the display area on the screen or the vertical scroll, it should be apparent to those skilled in the art that the present invention may also be adapted to control the horizontal scroll in the same manner. Further, the present invention is not limited to a high definition still picture system, but may be applied to an image display control apparatus which accomplishes predetermined display control using first to third image memories.

As described in detail above, the image display control apparatus embodying the present invention writes third image data into that part of a display area designated to the first and second frame memories from which image data has been read out, thus eliminating the need for the third frame memory for storing the third image data. This feature can ensure reduction in the memory capacity and the manufacturing cost without impairing the original functions of the apparatus.

What is claimed is:

1. An image display control apparatus comprising:

a first frame memory for storing first image data in association with horizontal and vertical coordinates;

a second frame memory for storing second image data in association with horizontal and vertical coordinates;

display area designating means for designating to said first and second frame memories a display area for image data to be supplied to image display means and moving said display area in a predetermined direction in accordance with a scroll instruction;

read means for reading image data of said display area from said first and second frame memories, said read means reading image data sequentially, said read means reading an amount of said image data forming a field of video image to be displayed on said image display means only from said first frame memory, then from said first and second frame memories, then only from said second frame memory, and then from said first and second frame memories; and write means for sequentially writing third image data in that part of said designated display area of said first and second frame memories from which image data has been read out by said read means immediately after said image data has been sequentially read out by said read means.

2. An image display control apparatus comprising:

a first frame memory for storing first image data in association with horizontal and vertical coordinates;

a second frame memory for storing second image data in association with horizontal and vertical coordinates;

a third frame memory for storing third image data in association with horizontal and vertical coordinates;

display area designating means for designating to said first and second frame memories a display area for image data to be supplied to image display means and moving said display area in a predetermined direction in accordance with a scroll instruction;

read means for reading image data of said display area from said first and second frame memories, said read means reading image data sequentially, said read means reading an amount of said image data forming a field of video image to be displayed on said image display means only from portions of said first frame memory, then from portions of said first and second frame memories, then only from portions of said second memory, and then from portions of said first and second frame memories;

write means for sequentially writing fourth image data in that part of said designated display area of said first and second frame memories from which image data has been read out by said read means immediately after said image data has been sequentially read out by said read means; and control means for controlling data reading from and data writing in said third frame memory while said display area designating means moves said display area in said predetermined direction in accordance with said scroll instruction.

* * * * *